US006313579B1

(12) United States Patent
Nakano et al.

(10) Patent No.: US 6,313,579 B1
(45) Date of Patent: Nov. 6, 2001

(54) PLASMA DISPLAY PANEL WITH SEAL BONDING MEMBER

(75) Inventors: Takashi Nakano; Masaomi Ebe, both of Yamanashi (JP)

(73) Assignee: Pioneer Electronic Corporation, Tokyo (JP)

( * ) Notice: Subject to any disclaimer, the term of this patent is extended or adjusted under 35 U.S.C. 154(b) by 0 days.

(21) Appl. No.: 09/339,172

(22) Filed: Jun. 24, 1999

(30) Foreign Application Priority Data

Jun. 30, 1998 (JP) ..... 10-199653
Oct. 13, 1998 (JP) ..... 10-306346

(51) Int. Cl.[7] ..... H01J 1/62
(52) U.S. Cl. ..... 313/493; 313/484
(58) Field of Search ..... 313/484, 493

(56) References Cited

U.S. PATENT DOCUMENTS 3,716,742 * 2/1973 Nakayama et al. ..... 313/182
4,280,843 * 7/1981 Graff ..... 106/48
5,009,972 * 4/1991 Higuchi et al. ..... 430/7

FOREIGN PATENT DOCUMENTS

07105848A * 4/1995 (JP) ..... 313/484

* cited by examiner

*Primary Examiner*—Ashok Patel
*Assistant Examiner*—Todd Reed Hopper
(74) *Attorney, Agent, or Firm*—Sughrue, Mion, Zinn, Macpeak & Seas, PLLC

(57) ABSTRACT

A plasma display panel in which the reliability of seal bonding of a chip tube is assured and an evacuation working efficiency is improved. In a plasma display panel with a structure in which a glass substrate on the display surface side and a glass substrate on the rear side are adhered so as to be hermetically bonded by sealing layers through partitions and a gas is introduced into the space between the two glass substrates, an evacuation and gas charging hole is formed in one of the glass substrates and crystalline glass powder of a low melting point is molded into a predetermined shape and is baked, thereby seal bonding the chip tube into the evacuation and gas introducing hole.

10 Claims, 4 Drawing Sheets

FIG.5

| | COEFFICIENT OF THERMAL EXPANSION ($\times 10^{-7}/°C$) | DENSITY SHUNT RADIUS (mm) | CRACK OCCURRENCE RATIO | LEAKAGE OCCURRENCE RATIO |
|---|---|---|---|---|
| SEALING BONDING MEMBER 1 (EXAMPLE) | 61 | 22.9 | 0 | 0 |
| SEALING BONDING MEMBER 2 (EXAMPLE) | 63 | 23.0 | 0 | 0 |
| SEALING BONDING MEMBER 3 (EXAMPLE) | 64 | 23.1 | 0 | 0 |
| SEALING BONDING MEMBER 4 (COMPARISON) | 71 | 23.1 | × | 0 |
| SEALING BONDING MEMBER 5 (COMPARISON) | 84 | 23.1 | × | 0 |
| SEALING BONDING MENBER 6 (COMPARISON) | 85 | 20.4 | × | × |
| SEALING BONDING MEMBER 7 (COMPARISON) | 83 | 19.5 | × | × |

PLASMA DISPLAY PANEL WITH SEAL BONDING MEMBER

BACKGROUND OF THE INVENTION

1. Field of the Invention

The invention relates to a plasma display panel (PDP) of a self light emitting type using the gaseous discharge.

2. Description of Related Art

In recent years, a plasma display panel of an area discharge AC driving type is expected to be put into practical use as a large and thin color display apparatus.

FIG. 1 is a partial schematic diagram showing the structure of a plasma display panel of the area discharge AC driving type. The structure of the plasma display panel of the area discharge AC driving type will now be described below.

In FIG. 1, a plurality of pairs of row electrodes X and Y are arranged on a glass substrate 1 to be placed on a display side, so as to be parallel with each other. The row electrodes are constituted by transparent electrodes made of a transparent conductive film and metal electrodes made of a metal film each of which are laminated on an edge portion on an opposite side of a discharge gap of a transparent conductive film in order to augment the the conductivity of the transparent conductive film. Furthermore, a dielectric layer 2 is formed so as to cover the row electrodes X and Y. A protective layer (not shown) made of MgO is formed on the dielectric layer 2.

A plurality of column electrodes 4 which are arranged at predetermined intervals are formed on the inner surface side of a glass substrate 3 on the rear side so as to be in parallel with each other. Fluorescent layers 5 covering the column electrodes 4 are formed.

The row electrodes X and Y and the column electrodes 4 are arranged so as to be perpendicular to each other while maintaining a distance between them, thereby forming discharge spaces 6 between the glass substrate 1 on the display surface side and the glass substrate 3 on the rear side. A rare gas is hermetically charged and filled in the discharge spaces 6.

A rib (partition) 7 of a predetermined height is formed between the respective column electrodes 4 on the glass substrate 3 on the rear side. The ribs 7 partition the plural pairs of row electrodes X and Y and the plural column electrodes 4 which cross each other, thereby each forming a unit light emitting region having a light emitting surface of a predetermined area.

For the charging of the rare gas, at first, a frit paste containing amorphous or crystalline glass powder of a low melting point as a main component is coated onto an outer peripheral non-display region of the glass substrate 3 on the rear side so as to surround a display region. Then a temporary baking is performed, and sealing layers 8 are formed. After that, the glass substrate 3 on the rear side is turned upside down, the glass substrate 1 on the display surface side and the glass substrate 3 on the rear side are overlaid, and a periphery is temporarily fixed with clips.

An evacuation and gas charging hole 9 is formed in the glass substrate 3 on the rear side. A chip tube 11 is attached to the evacuation and gas charging hole 9 by an adhesive agent 10 made of a frit paste containing amorphous glass powder of a low melting point as a main component.

The chip tube 11 is attached as mentioned above, the temporarily fixed two glass substrates 1 and 3 are put into a chamber (not shown) and heated, the sealing layers 8 and adhesive agent 10 are baked, the two glass substrates 1 and 3 are adhered, and the chip tube 11 is hermetically bonded into the evacuation and gas charging hole 9 of the glass substrate 3.

A vacuum pump and a gas cylinder are connected to the chip tube 11 through a closable valve (not shown). The closable valve of the vacuum pump is first opened and the inner air is vacuumed by the vacuum pump, thereby evacuating the air in the space between the two glass substrates 1 and 3. In this instance, the two glass substrates 1 and 3 are heated at a predetermined temperature during the evacuation.

Subsequently, the closable valve of the gas cylinder is opened and the rare gas is introduced from the gas cylinder. After the gas has been introduced in this manner, the opening portion of the chip tube 11 is closed and the rare gas is introduced into a space between the two glass substrates 1 and 3.

Although the chip tube was sealed and bonded by using the amorphous glass powder of a low melting point as mentioned above, the amorphous glass has a temperature difference of tens of degree between a working temperature for seal bonding (temperature at which the glass is softened and fluidity increases) and a solidifying temperature (temperature at which the glass is not softened and does not flow).

Now considering performance such as color temperature characteristics or the like of the plasma display panel, it is better that the working temperature to seal bond the chip tube is low. On the contrary, it is better that the heating temperature in the evacuating step is high. When the amorphous glass powder of a low melting point is used to seal bond the chip tube as mentioned above, if the heating temperature in the evacuating step is raised, the fluidity of the amorphous glass increases and the glass is likely to leak, so that there is a drawback that reliability of high vacuum sealing can be insufficient.

OBJECT AND SUMMARY OF THE INVENTION

The invention has been made to solve the above problems and it is an object to provide a plasma display panel in which the reliability of seal bonding of a chip tube is assured and an evacuating working efficiency is improved.

According to the first aspect of the invention, there is provided a plasma display panel in which glass substrates on the display surface side and the rear side are joined so as to be hermetically bonded by sealing layers through partitions and a gas is introduced into a space between the glass substrates, wherein an evacuation and gas charging hole is formed in one of the glass substrates and a chip tube is fixedly bonded to the evacuation and gas charging hole by using a seal bonding member obtained by molding and baking crystalline glass powder of a low melting point into a predetermined shape.

According to the second aspect of the invention, in the plasma display panel according to the first aspect of the invention, the seal bonding member is formed so as to have a concave portion into which a seal bonding portion of the chip tube is fitted.

According to the third aspect of the invention, in the plasma display panel according to the first aspect of the invention, a coefficient of thermal expansion of the seal bonding member has a value that is 0.8 to 0.65 time as large as the thermal expansion coefficient of the glass substrate.

According to the plasma display panel of the invention, it has a structure such that the glass substrates on the display surface side and the rear side are adhered so as to be hermetically bonded by the sealing layers through the partitions and the gas is introduced into a space between the two glass substrates. The evacuation and gas charging hole is formed in one of the glass substrates. The crystalline glass powder of a low melting point is molded into a predetermined shape and is baked, thereby seal bonding the chip tube to the evacuation and gas charging hole. Thus, the reliability of the seal bonding of the chip tube is assured and the evacuation working efficiency is improved.

By constructing the seal bonding member by the concave portion into which the seal bonding portion of the chip tube is fitted, the whole outer peripheral portion of the seal bonding portion of the chip tube is hermetically bonded and the reliability of the seal bonding of the chip tube is assured.

If the seal bonding member in which a coefficient of thermal expansion is 0.8 to 0.65 time as large as that of the glass substrate is used, the reliability of the seal bonding of the chip tube is further assured.

BRIEF DESCRIPTION OF THE DRAWINGS

FIG. 5 is a diagram showing results of characteristics when the chip tube is hermetically bonded by using seal bonding members obtained by changing values of a coefficient of thermal expansion and a density shunt radius.

DETAILED DESCRIPTION OF THE PREFERRED EMBODIMENT

Figure 1:
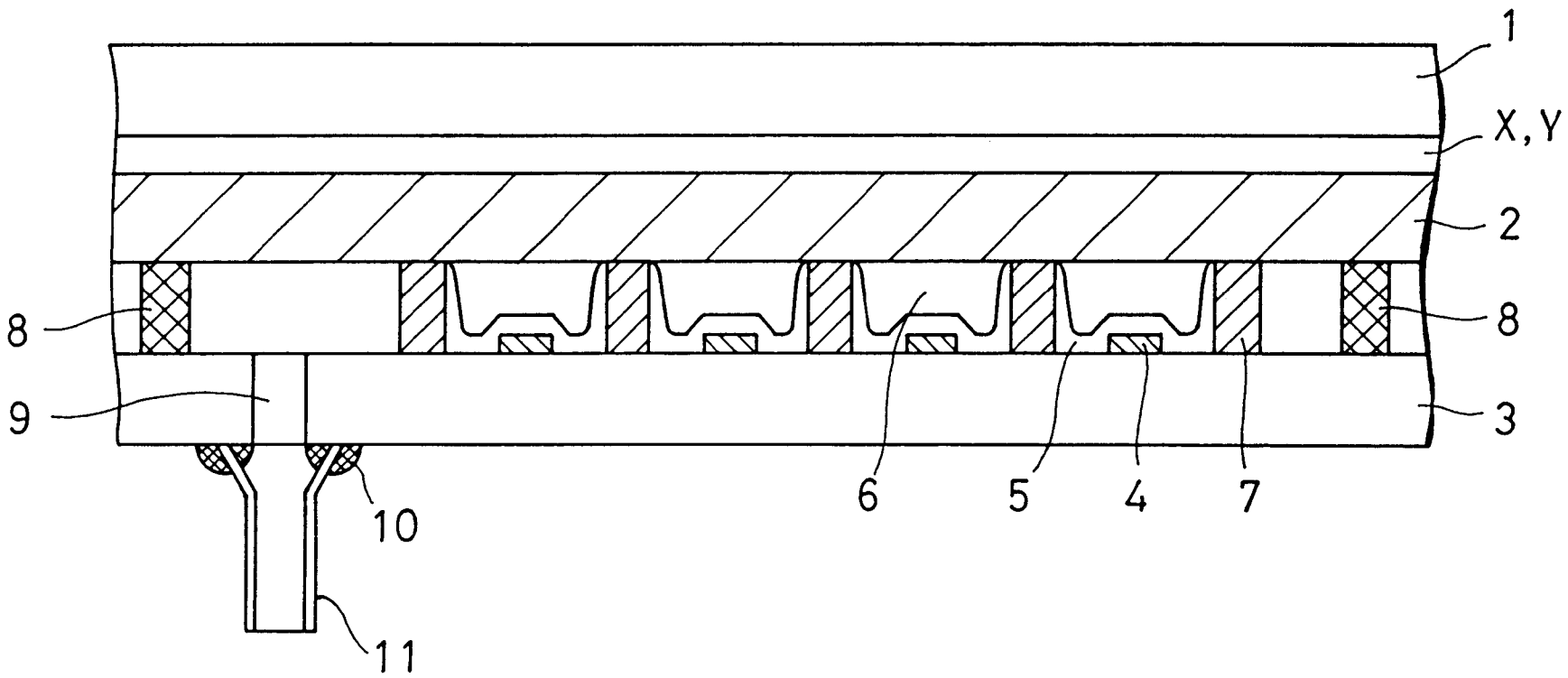
FIG. 1 PRIOR ART
FIG. 1 is a cross sectional view showing a chip tube seal bonding structure of a plasma display panel in the prior art.
Figure 2:
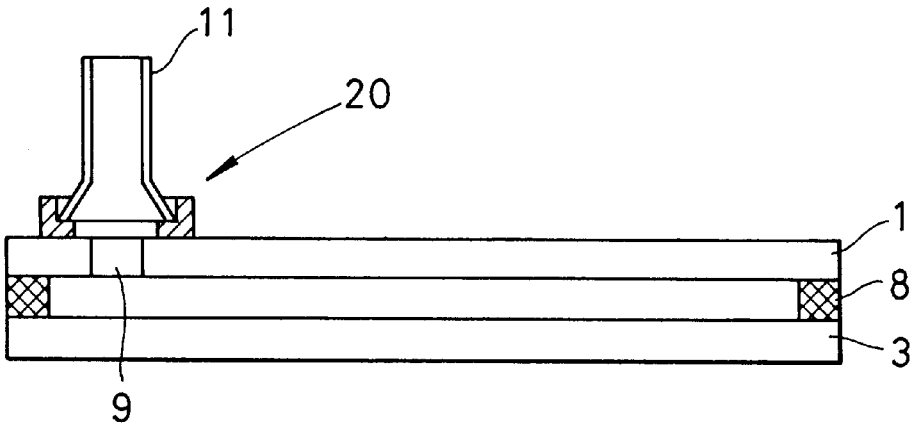
FIG. 2 is a cross sectional view for explaining an embodiment of the plasma display panel of an surface discharge type according to the invention.

FIG. 2 is a cross sectional view for explaining a construction of a plasma display panel according to an embodiment of the invention.

Figure 3:
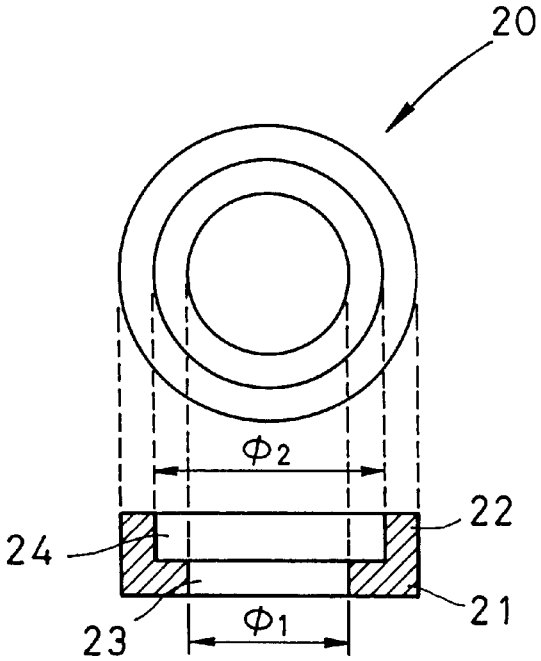
FIG. 3 is a plan view and a cross sectional view for explaining a seal bonding member of a chip tube in FIG. 2.
Figure 4:
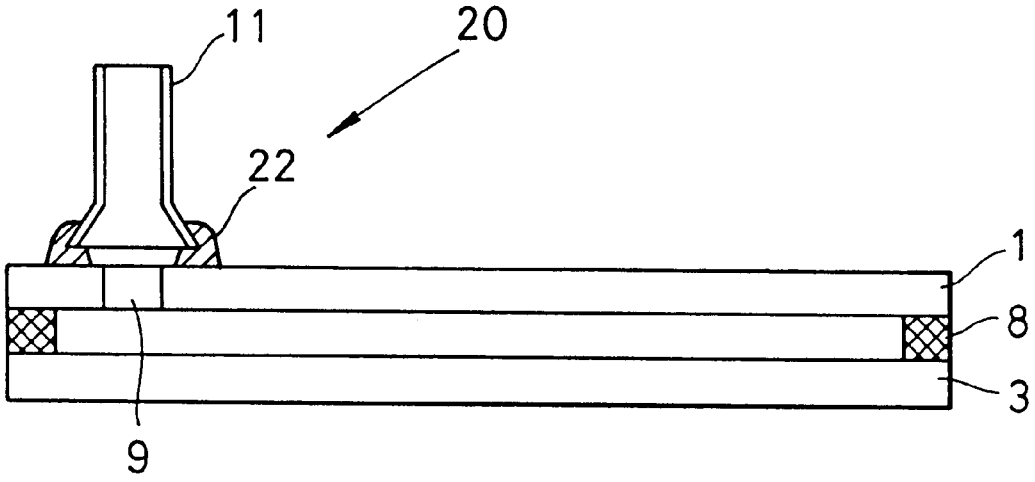
FIG. 4 is a cross sectional view showing a state in which the chip tube has been hermetically bonded.

FIG. 3 is an enlarged plan view of a seal bonding member of a chip tube and its cross sectional view. FIG. 4 is a cross sectional view of a plasma display panel showing a state where the seal bonding member has been baked and the chip tube has been hermetically bonded.

In FIGS. 2 and 4, the portions corresponding to the row electrodes X and Y, dielectric layer 2, column electrodes 4, fluorescent layers 5, ribs 7, and the like which are constructed in the space between the glass substrate 1 on the display surface side and the glass substrate 3 on the rear side are omitted. The portions having the same functions as those in the prior art are designated by the same reference numerals.

A seal bonding structure of the chip tube in the plasma display panel will now be described hereinafter with reference to the drawings.

First, on the inner surface of the glass substrate 1 on the display surface side, the row electrodes X and Y comprising transparent electrodes and thick film metal electrodes, the dielectric layer 2 made of glass of a low melting point, and a protective layer made of magnesium oxide (MgO) are laminated and formed in accordance with this order.

On the inner surface of the glass substrate 3 on the rear side, the column electrodes 4, the partitions 7 formed on the column electrodes 4, and the fluorescent layers 5 covering the side surfaces of the column electrodes 4 and partitions 7 are formed. A frit paste containing amorphous or crystalline glass powder of a low melting point as a main component is coated onto an outer peripheral non-display region of the glass substrate 3 on the rear side so as to surround a display region and the baked sealing layers 8 are formed.

The evacuation and gas charging hole 9 is formed in the glass substrate 3 on the rear side. The chip tube 11 is attached to the evacuation and gas charging hole 9 through a seal bonding member 20.

The seal bonding member 20 is formed by molding crystalline glass powder of a low melting point made of a mixture of lead borosilicate glass and baking it and has a softening point of about 390° C.

As shown in FIG. 3, the seal bonding member 20 is cylindrical. An inner diameter $\phi_1$ of a first portion 21 which is come into contact with a peripheral portion of the evacuation and gas charging hole 9 of the glass substrate 3 on the rear side is larger than that of the evacuation and gas charging hole 9. An inner diameter $\phi_2$ of a second portion 22 subsequent to the first portion 21 is larger than that of the inner diameter $\ddot{o}_1$ of the first portion 21.

A stairway portion is formed between a first opening portion 23 corresponding to the inner diameter $\phi_1$ of the first portion 21 and a second opening portion 24 corresponding to the inner diameter $\phi_2$ of the second portion 22. A funnel-shaped front edge portion (seal bonding portion) of the chip tube 11 is inserted into the second opening portion 24 (concave portion) and is formed so as to be come into contact with the stairway portion.

A manufacturing method of the plasma display panel according to the invention will now be described hereinafter.

(1) At first, the glass substrate 1 on the display surface side on which the row electrodes X and Y comprising the transparent electrodes and the thick film metal electrodes, the dielectric layer 2 made of glass of a low melting point, and the protective layer made of magnesium oxide (MgO) are laminated and formed in accordance with this order is prepared. The glass substrate 3 on the rear side on which the column electrodes 4, partitions 7 provided for the column electrodes 4, and the fluorescent layers 5 covering the side surfaces of the column electrodes 4 and partitions 7 are formed is also prepared.

(2) Subsequently, the frit paste containing amorphous or crystalline glass powder of a low melting point as a main component is coated onto an outer peripheral non-display region of the glass substrate 3 on the rear side so as to surround a display region. A temporary baking is performed and the sealing layers 8 are formed. After that, the glass substrate 3 on the rear side is turned upside down. The glass substrate 1 on the display surface side and the glass substrate 3 on the rear side are overlaid through the partitions 7 which specify discharge gaps so that the row electrodes X and Y and the column electrodes 4 perpendicularly cross each other. The periphery of the overlaid glass substrates is temporarily fixed with clips.

(3) Then, the evacuation and gas charging hole 9 is formed in the glass substrate 3 on the rear side. The seal bonding member 20 obtained by molding and baking the crystalline glass powder of a low melting point is arranged on the evacuation and gas charging hole 9. The front edge of the chip tube 11 is inserted into the concave portion of the seal bonding member 20. The seal bonding member 20 and chip tube 11 are fixed by using a fixing jig (not shown).

(4) The two glass substrates 1 and 3 to which the chip tube 11 was attached and which were temporarily fixed as mentioned above are inserted into a chamber (not shown). The sealing layers 8 and seal bonding member 20 are baked at 400 to 500° C. for 20 to 30 minutes or longer. Two glass substrates 1 and 3 are adhered. The chip tube 11 is hermetically bonded to the evacuation and gas charging hole 9 of the glass substrate 3 on the rear side.

As shown in FIG. 4, when the seal bonding member 20 is baked, the thin second portion 22 of the seal bonding member 20 is slightly softened and flows, thereby hermetically bonding the front edge funnel-shaped tapered outer surface of the chip tube 11.

(5) Subsequently, a vacuum pump and a gas cylinder are connected to the chip tube 11 through a closable valve. First, by opening a closable valve of the vacuum pump and vacuuming the inside air by the vacuum pump, the air in the space between the two glass substrates 1 and 3 is evacuated.

(6) A closable valve of the gas cylinder is opened and a rare gas is introduced from the gas cylinder. After the gas was introduced, the opening portion of the chip tube 11 is closed and the rare gas is introduced into the space between the two glass substrates 1 and 3.

FIG. 5 shows results of characteristics when the chip tube is hermetically bonded by using each seal bonding member (crystalline molded frit) obtained by changing the values of the coefficient of thermal expansion and the density shunt radius.

The density shunt radius represents a change amount of the diameter of a product when a molding object obtained by molding a crystalline frit into a disk-like shape is heated at a predetermined temperature (about 450° C.) for a predetermined time (about 4 hours). The crack occurrence ratio denotes a ratio at which a crack occurs on the seal bonding surface of the glass substrate in the heating step after the chip tube has been hermetically bonded to the glass substrate by using each seal bonding member. In the diagram, a mark ○ denotes a case where the crack hardly occurs and a mark x indicates a case where the crack occurrence ratio is large. The leakage occurrence ratio is a ratio at which after the chip tube has been hermetically bonded to the glass substrate by using each seal bonding member, a crack occurs in the seal bonding member and a leakage occurs from the crack. A mark ○ denotes a case where the leakage hardly occurs and a mark x indicates a case where the leakage occurrence ratio is large.

The glass substrate in which a coefficient of thermal expansion is equal to 83 to 87 (×10−7/° C.) is used. As a thermal expansion coefficient of the crystalline frit, a value within a range such that a compression strain does not occur on the seal bonding surface of the glass substrate is selected. If the compression strain remains, there is a fear such that if the compression strain remains, a crack occurs on the seal bonding surface of the glass substrate from this portion as a start point. Considering a variation in thermal expansion coefficient, it is preferable that a tensile strain of a certain extent is left on the seal bonding surface of the glass substrate. That is, it is desirable to set a thermal expansion coefficient kl of the crystalline frit to a value that is 0.8 to 0.65 time as large as a thermal expansion coefficient k2 of the glass substrate. When the thermal expansion coefficient k1 of the crystalline frit is equal to or larger than 0.8×k2, the crack occurrence ratio on the seal bonding surface of the glass substrate increases. When the thermal expansion coefficient k1 of the crystalline frit is equal to or less than 0.65×k2, contrarily, the crack of the crystalline frit easily occurs due to the compression strain remaining in the crystalline frit. The density shunt radius vector shows a fluidity at the time of heating. When the density shunt radius vector is too small (the density shunt radius vector is less than about 21 mm), a crack occurs in the seal bonding portion of the crystalline frit after the seal bonding and a leakage slowly occurs from the crack. It is, therefore, desirable that the density shunt radius vector of the crystalline frit is equal to or larger than 21 mm.

In the above embodiment, although the evacuation and gas charging hole 9 is formed in the outer peripheral display region of the glass substrate 3 on the rear side, the invention is not limited to it. The evacuation and gas charging hole 9 can be formed in the outer peripheral display region of the glass substrate 1 on the display surface side. The seal bonding member 20 is not limited to the construction of FIG. 3 but can be molded into a predetermined shape such as a flat shape having an opening portion.

As mentioned above, in the plasma display panel according to the embodiment of the invention, the evacuation and gas charging hole is formed in one of the glass substrate and when the chip tube is fixedly attached into the evacuation and gas charging hole, the seal bonding member obtained by molding and baking the crystalline glass powder of a low melting point into a predetermined shape is used. The heating temperature during the evacuation and the baking temperature of the seal bonding member, therefore, can be set to almost the same temperature. The working time is reduced. The color temperature characteristics of the plasma display panel can be improved. After the seal bonding member was baked, the seal bonding member is uniformly solidified and the shape becomes uniform, so that the yield is improved.

What is claimed is:

1. A plasma display panel in which a glass substrate on a display surface side and a glass substrate on a rear side are adhered so as to be hermetically bonded by sealing layers through partitions and a gas is introduced into a space between said glass substrates, wherein an evacuation and gas charging hole is formed in one of said glass substrates, and said plasma display panel has a chip tube fixedly bonded to said evacuation and gas charging hole by using a seal bonding member obtained by molding and baking crystalline glass powder of a low melting point into a predetermined shape, wherein a coefficient of thermal expansion of said seal bonding member has a value that is 0.8 to 0.65 times as large as that of said glass substrate.

2. A panel according to claim 1, wherein said seal bonding member has a concave portion into which a seal bonding portion of said chip tube is fitted.

3. A panel according to claim 1, wherein the crystalline glass powder of said seal bonding member comprises lead borosilicate glass that has a softening point of about 390° C.

4. A panel according to claim 1, wherein said seal bonding member is cylindrical.

5. A panel according to claim 1, wherein said seal bonding member comprises first and second cylindrical portions.

6. A panel according to claim 5, wherein said first cylindrical portion has a first inner diameter, and said second cylindrical portion has a second inner diameter, the second inner diameter being larger than the first inner diameter.

7. A panel according to claim 1, wherein said chip tube further comprises a funnel-shaped front edge portion.

8. A panel according to claim 7, the funnel-shaped front edge of said chip tube being in contact with said seal bonding member.

9. A panel according to claim 8, wherein the funnel-shaped front edge-portion of said chip tube is hermetically bonded to said seal bonding member.

10. A panel according to claim 1, wherein said seal bonding member has a density shunt radius vector equal to or greater than 21 mm.

* * * * *